United States Patent [19]

Van Leer

[11] 3,970,240

[45] July 20, 1976

[54] CONTAINER FOR LIQUIDS

[75] Inventor: Oscar Jacques Van Leer, Amstelveen, Netherlands

[73] Assignee: Koninklijke Emballage Industrie Van Leer B.V., Amstelveen, Netherlands

[22] Filed: June 16, 1975

[21] Appl. No.: 587,053

[30] Foreign Application Priority Data

June 17, 1974 Netherlands ..... 7408072

[52] U.S. Cl. ..... 229/22; 229/7 R

[51] Int. Cl.[2] ..... B65D 5/02

[58] Field of Search ..... 229/22, 7 R, 17 R

[56] References Cited

UNITED STATES PATENTS

| | | | |
|---|---|---|---|
| 3,022,886 | 2/1962 | Jarnhall | 229/22 X |
| 3,744,625 | 7/1973 | Chin | 229/22 X |
| 3,791,570 | 2/1974 | Hopkins | 229/7 R |
| 3,844,470 | 10/1974 | Rohde | 229/22 |

*Primary Examiner*—Davis T. Moorhead

*Attorney, Agent, or Firm*—Stevens, Davis, Miller & Mosher

[57] ABSTRACT

A container for liquids which takes the form of a spatial polygon having side planes of identical congruent triangles. The container consists of six triangular planes three of which have their bases against the bases of the other three and the top angle of each three meet at a point opposite to the point where the top angle of the other three meet.

3 Claims, 3 Drawing Figures

CONTAINER FOR LIQUIDS

The invention relates to a container for liquids such as pastes, powders, which container has the form of a spatial polygon, the side-planes of which consisting of identical, in particular congruent triangles. Such containers are generally known in the form of a tetrahedron and serve as packing of milk or soft drinks. These known containers can be manufactured in a simple way by pinching off transversely upon the longitudinal axis a tubular initial work-piece according to straight lines and then welding the walls pressed against each other, each following weld being turned 90° with respect to the preceding weld. Such a tetrahedron is a firm body being very suitable for the storage of liquids, which liquids easily can be removed by pricking a hole in a wall or by cutting off one tip.

A disadvantage of the tetrahedron is that it cannot easily be pressed flat and less viscous substances sometimes are difficult to remove, whereas in empty condition it forms a voluminous waste product.

Purpose of the invention is to provide a container which with maintenance of a good rigidity easily can be emptied and as a waste product easily can be removed.

According to the invention this purpose is achieved in that the container consists of six triangular planes, which three by three meet with the top angles in two opposite points and placed with their bases against each other. With such a container the course of the ribs of the spatial polygon is such, that when snapping one of the ribs the container can be folded flat.

Preferably at least one pair of two triangles, placed with their bases against each other, is manufactured with a folding line, running from the top of one triangle to the top of the other triangle and perpendicularly intersecting the bases, in this way obtaining a container which can easily be emptied when making an interstice in the tip opposite the collapsible side. In this way a container can be manufactured for each paste- or jelly-like material, such as many foodstuffs, cosmetics, tooth-paste, etc., which container can easily and in particular as compared with the tube be emptied without fail. If necessary the container can be provided with a screwcap closure in the tip.

Preferably a material consisting of thermoplastic synthetic material is applied and the ribs forming the folding lines of the polygon are treated such, e.g. by pressing flat in hot condition, that the thermoplastic memory of the material tries to bring the container in the position in which it is empty and undesired empty spaces with infiltrations of air in the interior of the container are avoided. In this way one obtaines, for example, a very practical replacement for tubes.

The container remains suitable for filling with liquids and can also be used successfully for the storage and delivery of pulverized or granular material.

The invention also relates to a method for manufacturing a similar container with which in a known manner use is made of a strip of welding material being formed into a tube, which tube is pinched off and welded at distances from each other according to straight lines transversely upon the longitudinal axis, which welds are turned 90° with respect to each other, all this as known with the manufacture of tetrahedrons, and according to the invention the strip-shaped material can be provided with two pairs of intersecting folding lines, which pairs are fixed next to each other such, that after forming the tube these pairs are at both sides of the tube with each pair moved 90° with respect to the following pair, which pairs of folding lines are adjusted at such distances from each other, seen in the longitudinal direction of the tube, that in between there is room for a flat transverse strip by welding the opposite walls together, as well as for welding together the tube-walls parallel to the upper branches of the folding lines.

In this way the container can continuously be manufactured and can be filled in the same way as known with the tetrahedron with which the filling takes place via a centrally adjusted filling pipe in the tube, debouching above the weld.

However, it is also possible to manufacture the container by injection moulding.

The invention now will be further elucidated on the basis of the drawings.

Figure 1:
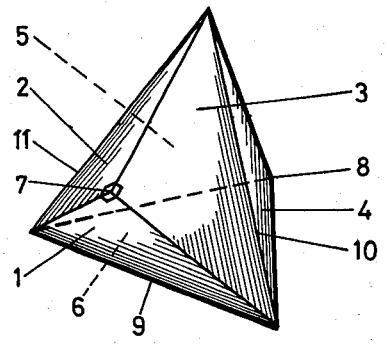
FIG. 1 shows in perspective the shape of a container according to the invention.

The container shown in FIG. 1 consists of six right-angled isosceles surfaces 1 to 6 inclusive, from which the top-angles meet at 7 and 8 and the bases of which meet at 9, 10, and 11, which bases are lying in the same plane.

Figure 2:
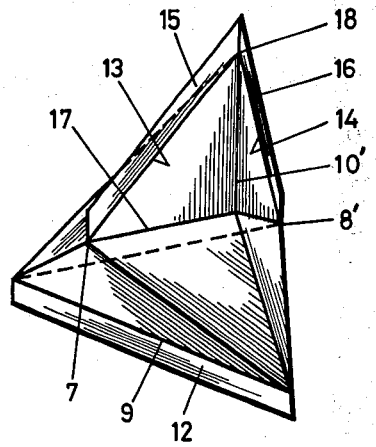
FIG. 2 shows a preferred embodiment.

FIG. 2 shows the same container, a welding strip 12, however, being present at the spot of the base 9, whilst at the spot of the ribs 13, 14 also weld-strips 15, 16 are adjusted. In this embodiment rib 10', which can be compared with rib 10 in FIG. 1, is snapped and intersected by a folding line 17 running from the top 7' to the top 8'. In consequence of this the triangular planes at both sides of rib 10' are divided in equal parts through which it is possible to completely fold flat the container by moving the top 18 to the rib 9.

Figure 3:
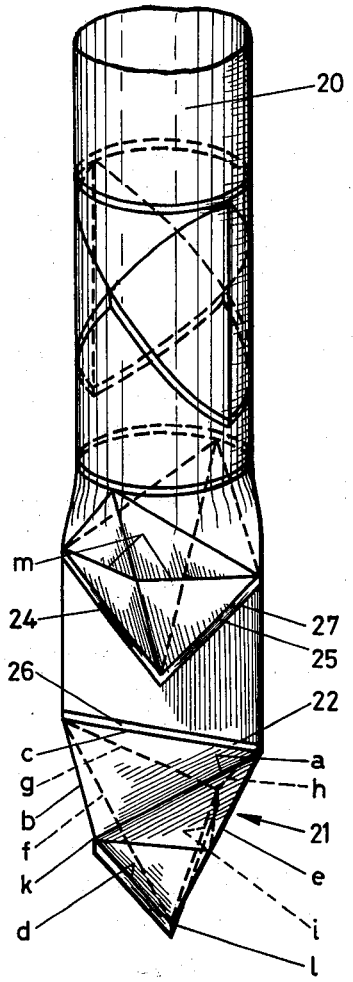
FIG. 3 is an elucidation of the method.

FIG. 3 shows schematically how the container according to the invention can be manufactured. In FIG. 3 a tubular initial work-piece 20 is shown which can be formed of a flat strip which is bent into a tube, the longitudinal edges overlapping each other being welded together. This strip-shaped material is preferably previously provided with a pattern of folding lines. The tube 20 at the upper end is sketched open and in the lower part already pressed flat and shows a container manufactured from the tube and in general indicated with 21. For forming the container the tube is each time pressed flat and to know alternately in directions turned in 90° with respect to each other. When pressing flat a horizontal weld 22 is formed as well as a V-shaped weld 24, 25. From the weld 22 the upper limiting line 26 forms a section line and with the welds 24, 25 this is the lower limited line 27. The container 21, made from the tube, is limited by straight lines, forming the sides of triangles and which can be found back in the form of folding lines upon the wall of the tubular work-piece. The folding lines, forming the ribs of the container are indicated with *a* up to and including *i. k* and *l* are folding lines in the welding strips 24, 25 and *m* is the folding line in that wall of the container, which folding line eventually might have the ability to be snapped.

In the drawing not every folding line is indicated with numerals.

The drawings only schematically indicate how the container according to the invention can look like. When the container is used for liquid the snapping of one wall, shown in FIG. 2, will be left out in order to give the container the greatest possible rigidity. When the empty container should be stored and take up as little room as possible, then one easily can squash one wall with the hand and the flattening can take place. When great strength of the container is not a first requirement the snapping wall naturally canbe used. The last mentioned embodiment will be especially useful for less viscous material such as pastes. Similar containers in very small construction for only one portion can be used in for example restaurants and in a somewhat larger construction for tooth-paste, cosmetics, etc. The container also can be used for powders and can easily be constructed such that pulverization of the powder can be achieved, for examle by the construction of an air-inlet valve in one wall closable by a seal and to provide the tip, which is opposite the collapsible wall, with a mark that the tip should be cut off. The container then works as a bellows.

In FIG. 3 the tips of the container point downwardly. This can be reversed as well. The manner as shown, however, has the advantage that already during manufacturing the container may be filled almost entirely.

What we claim is:

1. Container for liquids, such as pastes, powders, which container has the form of a spatial polygon, the sideplanes of which consisting of identical, in particular congruent triangles, characterized in that the container consists of six triangular planes which three by three meet with the top angles in two opposite points and placed with their bases against each other.

2. Container according to claim 1, characterized in that at least one pair of two triangles, placed with their bases against each other, is manufactured with a folding line, running from the top of one triangle to the top of the other triangle and perpendicularly intersecting the bases.

3. Container according to claim 2 made from material containing thermoplastic synthetic material, characterized in that all ribs of the polygon, formed by the coinciding sides of the triangles, are folding lines and are treated such that the container tries to take up a collapsible position.

* * * * *